US007152504B2

(12) United States Patent
Itoh

(10) Patent No.: US 7,152,504 B2
(45) Date of Patent: Dec. 26, 2006

(54) TUBE-PLUG EXTRACTING APPARATUS

(75) Inventor: Teruaki Itoh, Kumamoto (JP)

(73) Assignee: IDS Company, Ltd., Kumamoto (JP)

( * ) Notice: Subject to any disclaimer, the term of this patent is extended or adjusted under 35 U.S.C. 154(b) by 0 days.

(21) Appl. No.: 11/085,049

(22) Filed: Mar. 22, 2005

(65) Prior Publication Data

US 2005/0210671 A1 Sep. 29, 2005

(30) Foreign Application Priority Data

Mar. 26, 2004 (JP) ..... 2004-091871

(51) Int. Cl.
*B67B 7/00* (2006.01)

(52) U.S. Cl. ..... 81/3.2; 81/3.33; 81/3.39

(58) Field of Classification Search ..... 81/3.2, 81/3.32, 3.33, 3.37, 3.39, 3.36; 29/801
See application file for complete search history.

(56) References Cited

U.S. PATENT DOCUMENTS 4,522,089 A * 6/1985 Alvi ..... 81/3.42
4,982,553 A * 1/1991 Itoh ..... 53/246
5,255,574 A * 10/1993 Wuerschum ..... 81/3.2
5,490,321 A * 2/1996 Kaneko ..... 29/714
6,871,566 B1 * 3/2005 Niwayama et al. ..... 81/3.2

FOREIGN PATENT DOCUMENTS

| | | |
|---|---|---|
| JP | 5-228379 | 9/1993 |
| JP | 6-324051 | 11/1994 |
| JP | 2000-338111 | 12/2000 |
| JP | 2003-94374 | 4/2003 |

* cited by examiner

*Primary Examiner*—Hadi Shakeri
(74) *Attorney, Agent, or Firm*—Nixon & Vanderhye P.C.

(57) ABSTRACT

A tube-plug extracting apparatus has a clamping mechanism, movable frame, chucking mechanism, rotation mechanism, and vertical motion mechanism. The clamping mechanism holds a test tube upright. The movable frame is located over a plug extracting position and slides in a vertical direction. The chucking mechanism chucks a plug attached to the test tube. The rotation mechanism rotates the chucking mechanism. The vertical motion mechanism moves the movable frame in a direction to extract the plug. The vertical motion mechanism has ball screws and a drive motor. The ball screws have a stroke long enough to move the movable frame in order to shift a lower-limit stop position for chucking the plug corresponding to the size of test tube.

3 Claims, 5 Drawing Sheets

TUBE-PLUG EXTRACTING APPARATUS

CROSS-REFERENCE TO RELATED APPLICATIONS

This application is based upon and claims the benefit of priority from prior Japanese Patent Application No. 2004-091871, filed Mar. 26, 2004, the entire contents of which are incorporated herein by reference.

BACKGROUND OF THE INVENTION

1. Field of the Invention

The present invention relates to a tube-plug extracting apparatus capable of automatically extracting a plug from a test tube containing a sample, such as blood.

2. Description of the Related Art

A tube-plug extracting apparatus is described and shown in Paragraph 0007 and FIG. 1 of Jpn. Pat. Appln. KOKAI Publication No. 5-228379. In this apparatus, a plug that is put into a test tube is chucked by a distal end portion of an extracting arm with the tube held by a tube retainer. The extracting apparatus is constructed so that the chucked plug can be automatically extracted from the test tube in the direction in which the plug is pulled off by raising the extracting arm with a cylinder for vertical sliding.

The extracting arm of this apparatus has plug chucking claws on its distal end. Further, the extracting arm has a mechanism that turns the chucked plug through a predetermined angular range around its central axis in conjunction with a tilt guide as the arm is pulled up by the cylinder for vertical sliding.

Test tubes for use as sample containers include test tubes of different bores and lengths (ϕ13×75 mm, ϕ13×100 mm, ϕ16×75 mm, ϕ16×100 mm, etc.). There are also various types of plugs for these test tubes, including push-in rubber plugs, cork plugs, threaded screw plugs, etc.

However, the tube-plug extracting apparatus described in Jpn. Pat. Appln. KOKAI Publication No. 5-228379 is configured only to extract adaptive standard-typed plugs from test tubes of a fixed size. In other words, it is not provided with any means for adaptation to test tubes of different sizes or plug types. Thus, a lower-limit stop position of the cylinder that vertically moves the extracting arm cannot be adjusted corresponding to a change of length of the test tubes.

In the means for twisting the plug to extract it in conjunction with the tilt guide, an end roller on the extracting arm is configured to be pressed against a slope of the tilt guide by the urging force of a tension spring. This apparatus is designed to reduce the necessary force for plug extraction by turning the plug through only a certain angular range as it is extracted. Thus, the apparatus cannot remove a screw plug that requires several turns for its extraction.

BRIEF SUMMARY OF THE INVENTION

The object of the present invention is to provide a tube-plug extracting apparatus capable of quickly accurately extracting plugs of any of different types from test tubes of different sizes regardless of the tube size and type of plug attached to each test tube.

A tube-plug extracting apparatus according to the present invention comprises a clamping mechanism, movable frame, chucking mechanism, rotation mechanism, and vertical motion mechanism. The clamping mechanism holds a test tube upright in a plug extracting position. The movable frame is located over the plug extracting position and moves in a vertical direction without rotating. The chucking mechanism is attached to the movable frame for rotation around a vertical axis and chucks a plug attached to the test tube in the plug extracting position. The rotation mechanism is attached to the movable frame and rotates the chucking mechanism with the plug chucked thereby around the vertical axis. The vertical motion mechanism has ball screws and a drive motor and moves the movable frame in a direction to extract the plug while the chucking mechanism chucking the plug is rotating. The ball screws have an extra stroke in which a lower-limit stop position of the movable frame, along with the vertical motion mechanism, is shifted from a chucking position for the plug attached to the test tube of a maximum size to a chucking position for the plug attached to the test tube of a minimum size. The drive motor drives the ball screws. It actuates the ball screws to move the movable frame according to the size of the test tube held in the plug extracting position.

Vertical guide rails and sliders are provided in order to move the movable frame in the vertical direction without rotating it. The vertical guide rails are paired and located left and right outside the movable frame. The sliders are fixed to the movable frame and engage the vertical guide rails. As the sliders are slidingly guided along the vertical guide rails, the movable frame moves in the vertical direction without rotating.

In the tube-plug extracting apparatus according to the invention, use of only one ball screw can fulfill a necessary function. A pair of ball screws are provided in order to stabilize the operation of the movable frame that is mounted with the chucking mechanism and the rotation mechanism. Preferably, in this case, the paired ball screws are arranged individually on the opposite sides of a region in which the movable frame moves.

Preferably, the chucking mechanism includes a cylinder and a chuck. The cylinder is rotatably supported on the movable frame and rotated by the rotation mechanism. The chuck is provided on a lower end portion of the cylinder for rotation integral with the cylinder and is opened or closed as a piston rod attached to the cylinder advances or retreats.

Preferably, moreover, the rotation mechanism comprises a driven sprocket wheel fixed to the cylinder, a drive motor fixed to the movable frame, a driving sprocket wheel mounted on a rotating shaft of the drive motor, and an endless chain wound around the driving sprocket wheel and the driven sprocket wheel.

In the tube-plug extracting apparatus according to the invention, the test tube is held by the clamping mechanism, and the plug on the tube is extracted in a manner such that the chucking mechanism chucking the plug is rotated as the movable frame is raised in the direction to extract the plug. Thus, the plug can be extracted quickly and accurately from the tube regardless of to the size of the tube and type of plug attached to the tube.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A tube-plug extracting apparatus 100 according to an embodiment of the present invention will now be described with reference to FIGS. 1 to 6. The tube-plug extracting apparatus 100 extracts a plug 2 from a plugged test tube 1. The tube-plug extracting apparatus 100 deals with a plurality of test tubes of different dimensions, represented by the large-sized test tube 1, which has a large bore and is long, and a small-sized test tube 1*a* which has a small bore and is short.

Figure 1:
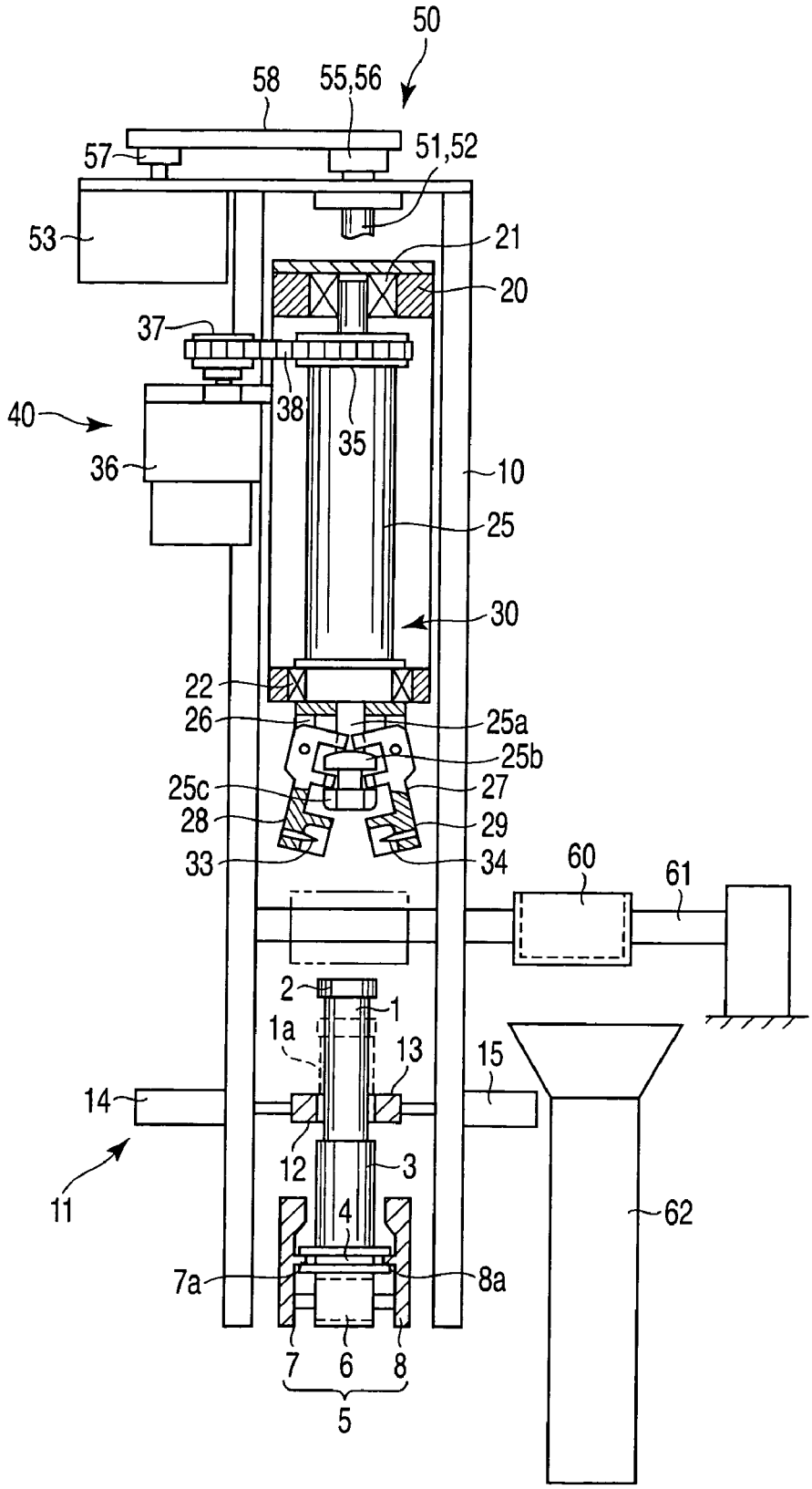
FIG. 1 is a central longitudinal sectional view showing a tube-plug extracting apparatus according to a first embodiment of the invention with its chucking mechanism opened.

In FIG. 1, the large- and small-sized test tubes 1 and 1*a* are represented by full and broken lines, respectively, for the sake of convenience. The test tube 1 or 1*a* contains a blood sample. Any other sample may be put in the tube 1 or 1*a*. An opening portion of the tube 1 or 1*a* is closed by a plug 2. The tube 1 or 1*a* is inserted into a tube holder 3 and kept upright therein.

The lower end portion of the tube holder 3 has a pair of flanges, upper and lower. Thus, an annular groove 4 is provided between the flanges. The holder 3 is provided with a leaf spring, which can hold the test tubes 1 and 1*a* of different bores in a socket portion. The tube-plug extracting apparatus 100 is located over a transport path 5 on which the tube holder 3 fitted with the tube 1 or 1*a* is transported intermittently at given intervals. The transport path 5 is composed of a belt conveyor 6 and conveyor rails 7 and 8.

The belt conveyor 6 is circulated while carrying the tube holder 3 intermittently. As shown in FIG. 1, the transport rails 7 and 8 are arranged individually on the opposite sides of the belt conveyor 6 and have guide ridges 7*a* and 8*a*, respectively. The ridges 7*a* and 8*a* can engage the groove 4 at the lower end portion of the holder 3. A plug extracting position is set on the middle of the transport path 5 that is located right under the tube-plug extracting apparatus 100. In this plug extracting position, the plug 2 is automatically extracted by the apparatus 100.

The tube-plug extracting apparatus 100 comprises a fixed frame 10, clamping mechanism 11, movable frame 20, chucking mechanism 30, rotation mechanism 40, and vertical motion mechanism 50. The fixed frame 10 is set vertically in the plug extracting position, spanning the transport path 5.

The clamping mechanism 11 is located inside the lower part of the fixed frame 10 and can hold the test tubes 1 and 1*a* of different bores in the plug extracting position. The movable frame 20 is located over the plug extracting position and attached to the fixed frame 10 so as to be movable in the vertical direction without rotating. The chucking mechanism 30 is mounted on the movable frame 20 for rotation around a vertical axis and chucks the plug 2 attached to the test tube 1 or 1*a* that is held in the plug extracting position. The rotation mechanism 40 is attached to the movable frame 20 and rotates the chucking mechanism 30 together with the plug 2 chucked thereby around the vertical axis. The vertical motion mechanism 50 keeps the chucking mechanism 30 rotating together with the plug 2 therein as it moves the movable frame 20 in the direction to extract the plug 2.

As shown in FIG. 1, the clamping mechanism 11 is composed of clamping members 12 and 13 and cylinders 14 and 15. The clamping members 12 and 13, which are paired, can hold the test tubes 1 and 1*a* of different bores. The cylinders 14 and 15 move their corresponding clamping members 12 and 13 toward or away from the tube 1 or 1*a*.

Figure 2:
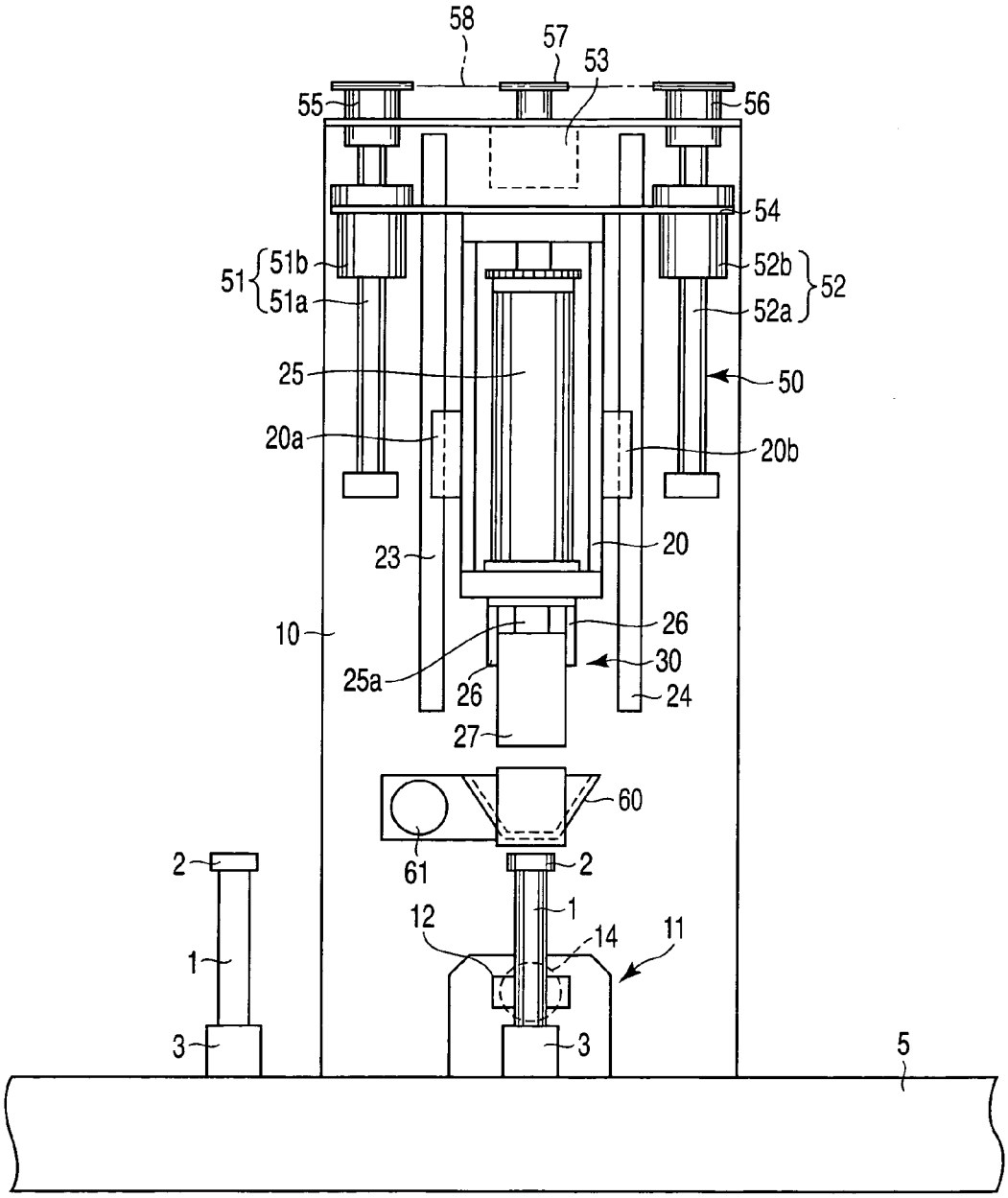
FIG. 2 is a front view of the tube-plug extracting apparatus shown in FIG. 1.

As shown in FIG. 2, a pair of vertical guide rails 23 and 24 are attached to the fixed frame 10. The movable frame 20 has sliders 20*a* and 20*b*, which engage the guide rails 23 and 24, respectively. The movable frame 20 moves in the vertical direction without rotating as it is slidingly guided along the guide rails 23 and 24 by the sliders 20*a* and 20*b*.

As shown in FIG. 1, the chucking mechanism 30 is provided with a cylinder 25, a shaft support portion 26, and a chuck 27. The cylinder 25 is rotatably supported on the movable frame 20 by bearings 21 and 22 and rotated by the rotation mechanism 40. The shaft support portion 26 is formed integrally with the cylinder 25 and rotates together with the cylinder 25. The chuck 27 is provided on the lower end portion of the cylinder 25 for rotation integral with the cylinder 25. It is opened or closed as a piston rod 25*a* of the cylinder 25 moves.

Figure 4:
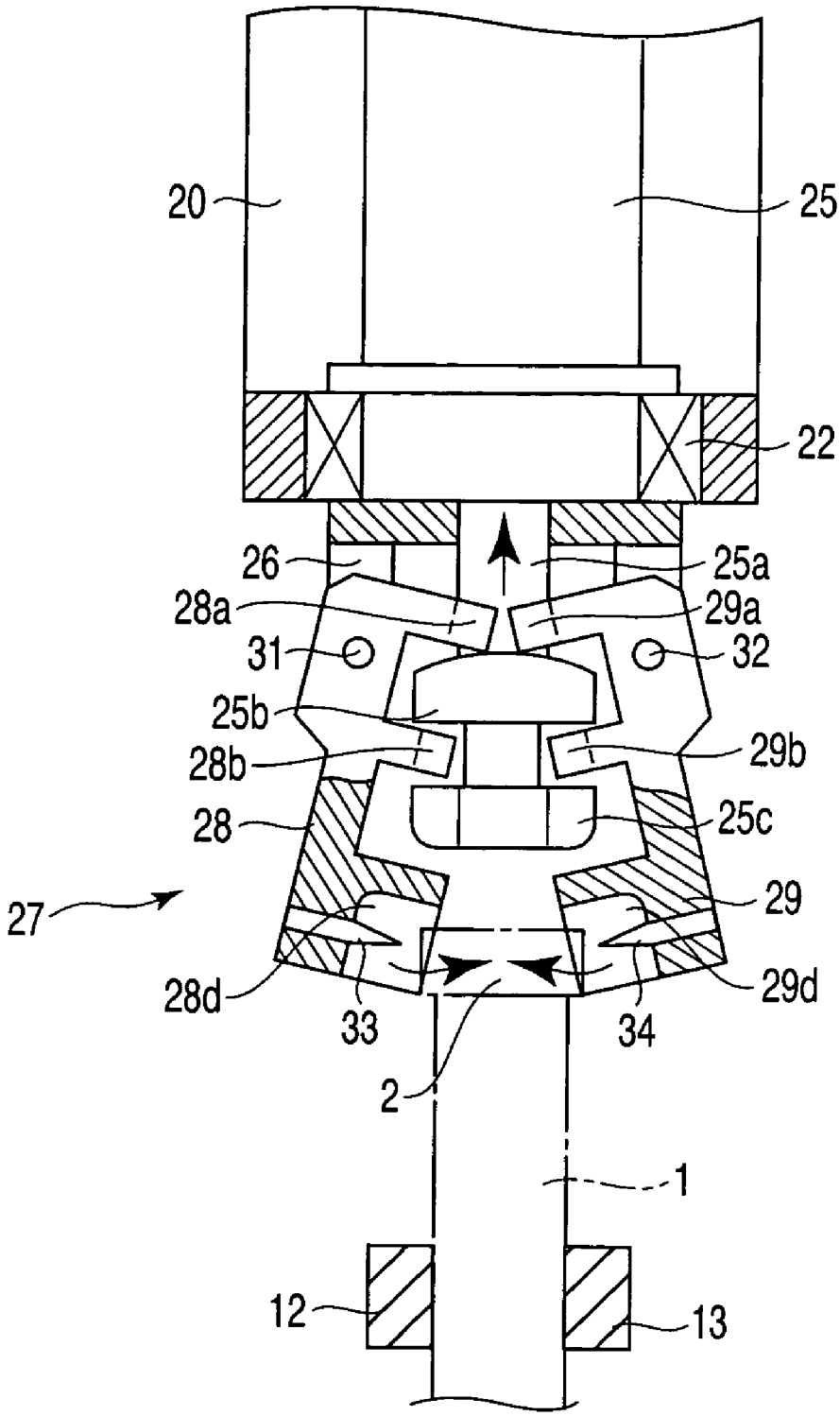
FIG. 4 is an enlarged view showing a principal part of the tube-plug extracting apparatus of FIG. 1 with its chucking mechanism in a lower-limit stop position.
Figure 5:
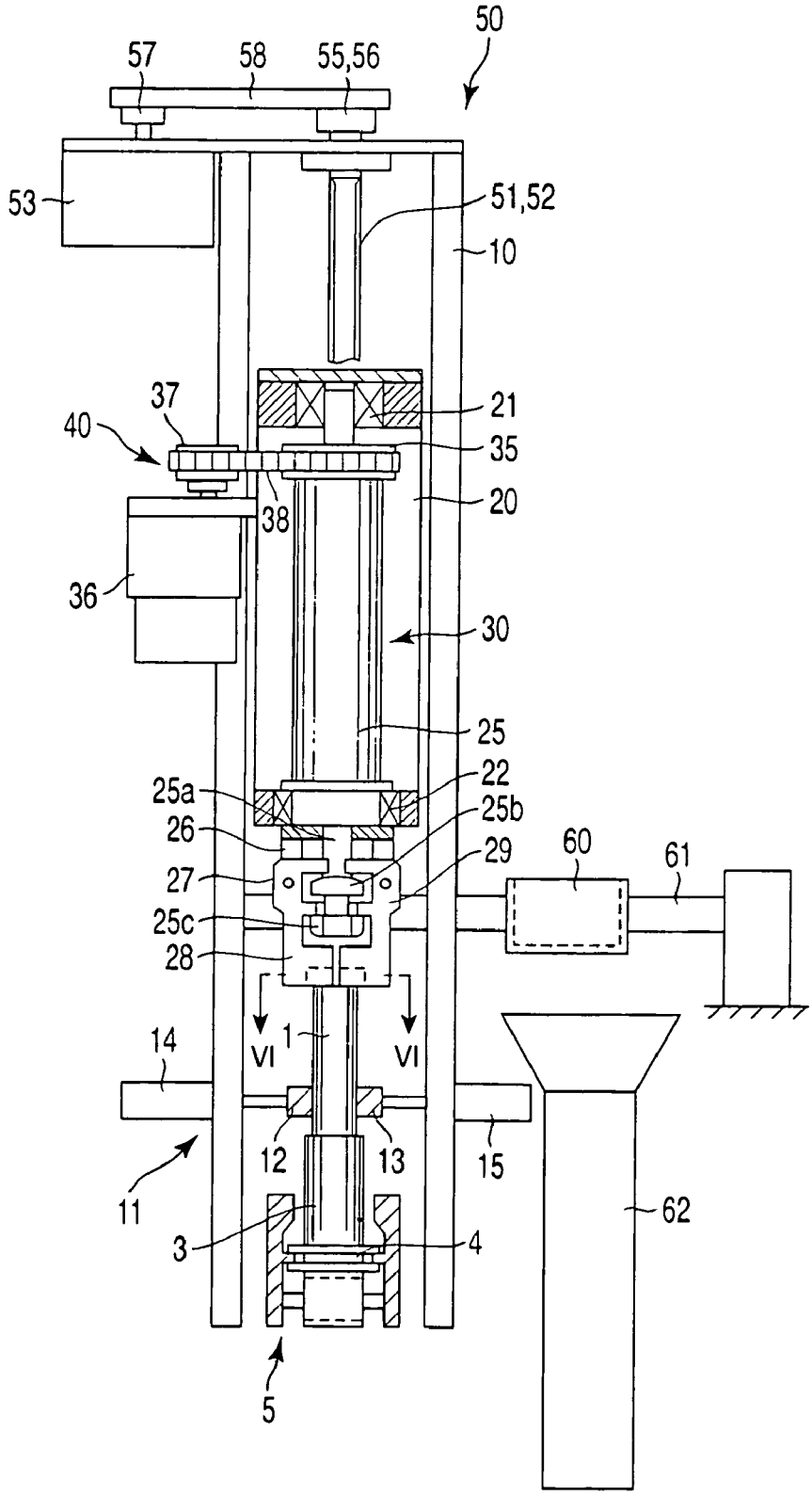
FIG. 5 is a central longitudinal sectional view of the tube-plug extracting apparatus of FIG. 1 with the chucking mechanism closed.

As shown in FIG. 4, the chuck 27 is provided with a pair of chuck members 28 and 29 that are pivotally supported on the shaft support portion 26 by pivots 31 and 32, respectively. Top engaging portions 28*a* and 29*a* protrude like a hook from the top parts of the chuck members 28 and 29, respectively. Arcuate engaging portions 28*b* and 29*b* protrude inward from intermediate parts of the chuck members 28 and 29 so that the pivots 31 and 32, pivotal points, are located between the top and intermediate parts.

The piston rod 25*a* of the cylinder 25 has a chuck operating block 25*b* and a rod bottom nut 25*c* on its end portions, individually. The top surface of the chuck operating block 25*b* is spherically curved. The chuck operating block 25*b* is situated between the top engaging portions 28*a* and 29*a* and the arcuate engaging portions 28*b* and 29*b* of the chuck members 28 and 29. The rod bottom nut 25*c* is situated below the arcuate engaging portions 28*b* and 29*b* of the chuck members 28 and 29.

When the piston rod 25*a* ascends, a spherical part of the chuck operating block 25*b* abuts against the top engaging portions 28*a* and 29*a* of the chuck members 28 and 29, thereby urging the chuck members 28 and 29 to close. When the piston rod 25*a* descends, the bottom surface portion of the chuck operating block 25*b* abuts against the arcuate engaging portions 28*b* and 29*b* of the chuck members 28 and 29, thereby urging the chuck members 28 and 29 to open.

Figure 6:
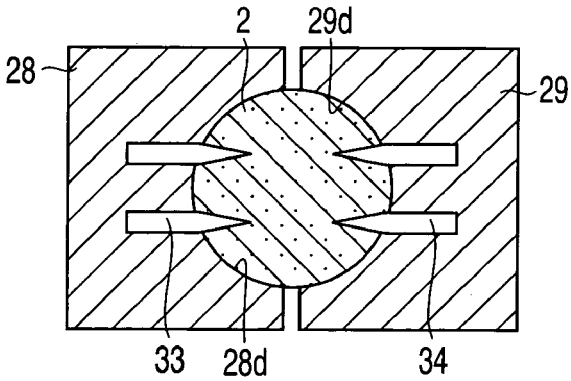
FIG. 6 is a sectional view of the chucking mechanism taken along line VI—VI of FIG. 5.

Plug nipping portions 28*d* and 29*d* are formed on the lower end portions of the chuck members 28 and 29. The plug nipping portions 28*d* and 29*d* that fit the plug 2 with a maximum outside diameter. Spikes 33 and 34 are arranged on the inner peripheral surfaces of the plug nipping portions 28*d* and 29*d*, respectively. As shown in FIG. 6, two pairs of spikes 33 and 34, four in total, are embedded in their corresponding chuck members 28 and 29 so that their respective sharp ends project inward.

As shown in FIG. 1, the rotation mechanism 40 that rotates the chucking mechanism 30 comprises a driven sprocket wheel 35, drive motor 36, driving sprocket wheel 37, and endless chain 38. The driven sprocket wheel 35 is fixed to the upper end portion of the cylinder 25. The drive motor 36 is a stepping motor that is fixed to the movable frame 20. The driving sprocket wheel 37 is fixed on a rotating shaft of the motor 36. The endless chain 38 is wound around the driven sprocket wheel 35 and drive sprocket wheel 37.

The vertical motion mechanism 50 comprises a pair of ball screws 51 and 52 and a drive motor 53. The ball screws 51 and 52 have an extra stroke besides a stroke in which the movable frame 20 is slid to extract the plug 2. In the extra stroke, the movable frame 20 is moved so that a lower-limit stop position of the chuck 27 is shifted from a chucking position for the plug 2 that is attached to the large-sized test tube 1 to a chucking position for the plug 2 that is attached to the small-sized test tube 1*a*. The drive motor 53 is a stepping motor that actuates the ball screws 51 and 52. In the tube-plug extracting apparatus 100, the drive motor 53 actuates the ball screws 51 and 52 to move the movable frame 20 corresponding to the length of the test tube in the vertical direction.

The vertical motion mechanism 50 will be described further in detail. The ball screws 51 and 52 are composed of screw shafts 51*a* and 52*a* and nut pieces 51*b* and 52*b*. The screw shafts 51*a* and 52*a* are supported on the fixed frame 10 so as to extend parallel to the vertical guide rails 23 and 24. The screw shafts 51*a* and 52*a* have a stroke long enough to allow the lower-limit stop position of the chuck 27 to be shifted from the chucking position for the plug 2 that is attached to the large-sized test tube 1 to the chucking position for the plug 2 that is attached to the small-sized test tube 1*a*.

Figure 3:
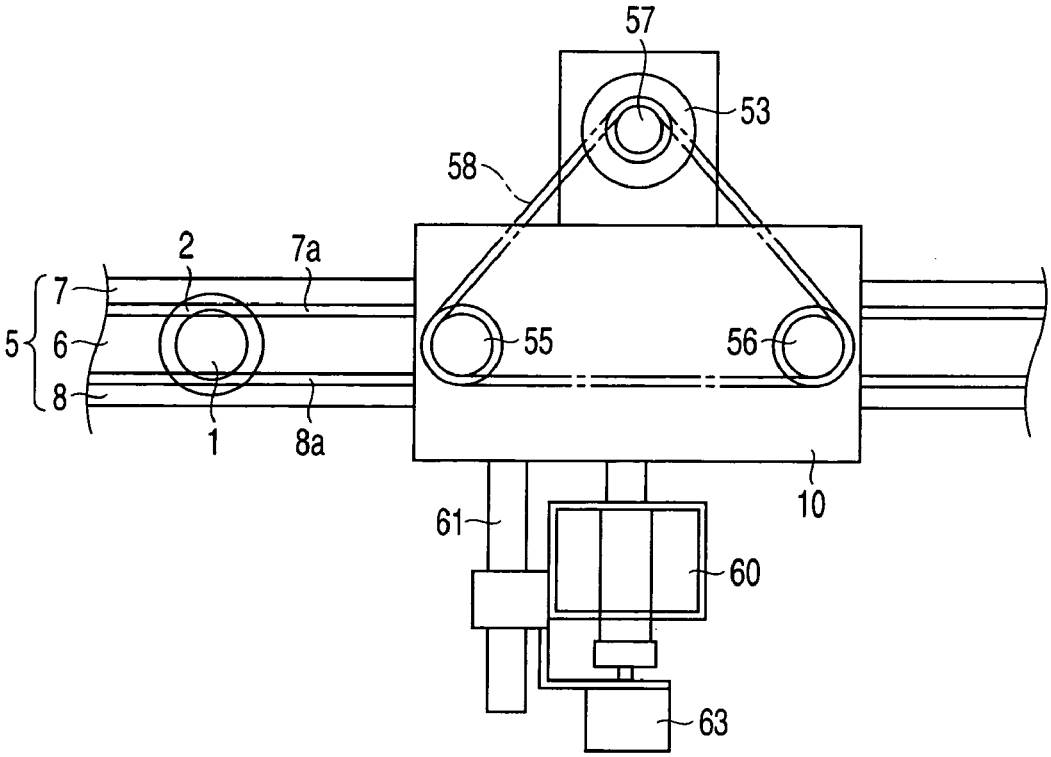
FIG. 3 is a plan view of the tube-plug extracting apparatus of FIG. 1.

The screw shafts 51*a* and 52*a* are inserted in the nut pieces 51*b* and 52*b*, respectively, which are fixed to the movable frame 20 by a mounting member 54. Sprocket wheels 55 and 56 are mounted on the top parts of the screw shafts 51*a* and 52*a*, respectively. As shown in FIGS. 1 and 2, a rotating shaft of the drive motor 53 is located extending parallel to the screw shafts 51*a* and 52*a* and fitted with a sprocket wheel 57, which is situated on the same plane of rotation as the sprocket wheels 55 and 56. As shown in FIG. 3, an endless chain 58 is wound around the sprocket wheels 55, 56 and 57.

The following is a description of the operation of the tube-plug extracting apparatus 100. In the state shown in FIG. 5, the chuck 27 is lowered to the chucking position for the plug 2 that is attached to the large-sized test tube 1, thereby chucking the plug 2. The test tube 1 is held by the clamping mechanism 11. When the rotation mechanism 40 is actuated, therefore, the whole chucking mechanism 30 rotates around the vertical axis, whereupon the plug 2 is turned. The moment the plug 2 starts to rotate, the vertical motion mechanism 50 is actuated to pull up the chucking mechanism 30 together with the movable frame 20. In consequence, the plug 2 is extracted from the tube 1.

A stepping motor is used as the drive motor 53. Therefore, the distance and speed of vertical movement of the movable frame 20 that is mounted with the chucking mechanism 30 can be easily adjusted by properly controlling the rotational speed of the drive motor 53. In an example of control, the movable frame 20 first starts to be moved at low speed. After the plug 2 is extracted, the movable frame 20 is raised at high speed. In this way, the plug 2 can be extracted without allowing the blood sample in the test tube 1 to scatter.

The extracted plug 2 is dropped into a receiving box 60 of a recovery device shown in FIGS. 1 to 3. The box 60 is coupled to a rodless cylinder 61. If the movable frame 20 is moved to its upper limit position with the plug 2 grasped by the chucking mechanism 30, the box 60 is delivered into a drop position indicated by two-dot chain line between the test tube 1 and the chuck 27 in FIG. 1. When the box 60 receives the plug 2 that is dropped as the chuck 27 is opened, it is moved by the cylinder 61 to a retreat position over a chute 62 that is set beside the transport path 5. In the retreat position, the box 60 is tilted toward an opening portion of the chute 62 by an actuator 63 shown in FIG. 3. The plug 2 is thrown into the chute 62 through the opening portion. Since other detailed arrangements are not associated with the spirit of the invention, a description of those arrangements is omitted.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A tube-plug extracting apparatus comprising:

a clamping mechanism holding a test tube upright in a plug extracting position;

a movable frame being located over the plug extracting position and being moved in a vertical direction without rotating;

a chucking mechanism being attached to the movable frame for rotation around a vertical axis and chucking a plug attached to the test tube in the plug extracting position;

a rotation mechanism being attached to the movable frame and rotating the chucking mechanism with the plug chucked thereby around the vertical axis;

a vertical motion mechanism moving the movable frame in a direction to extract the plug while the chucking mechanism chucking the plug is rotating;

ball screws being provided in the vertical motion mechanism and having an extra stroke in which a lower-limit stop position of the movable frame, along with the vertical motion mechanism, is shifted from a chucking position for the plug attached to the test tube of a maximum size to a chucking position for the plug attached to the test tube of a minimum size; and a drive motor being provided in the vertical motion mechanism and drives the ball screws, wherein the chucking mechanism includes:

a cylinder being rotatably supported on the movable frame and rotated by the rotation mechanism; and a chuck which is provided on a lower end portion of the cylinder for rotation integral with the cylinder and is opened or closed as a piston rod provided in the cylinder advances or retreats; and wherein the rotation mechanism comprises:

a drive motor fixed to the movable frame;

a driving sprocket wheel mounted on a rotating shaft of the drive motor;

a driven sprocket wheel fixed to the cylinder; and an endless chain wound around the driving sprocket wheel and the driven sprocket wheel.

2. A tube-plug extracting apparatus according to claim 1, further comprising:

a pair of vertical guide rails, left and right, arranged outside the movable frame; and sliders being fixed to the movable frame and engagedly guided by the guide rails.

3. A tube-plug extracting apparatus according to claim 1, wherein the ball screws are paired and arranged individually on the opposite sides of a region in which the movable frame moves.

* * * * *